US005316218A

United States Patent [19]

Bowen

[11] Patent Number: 5,316,218

[45] Date of Patent: May 31, 1994

[54] ROTATING NOZZLE

[75] Inventor: Strachan D. Bowen, Holland Landing, Canada

[73] Assignee: Bex Engineering Ltd., Ontario, Canada

[21] Appl. No.: 60,119

[22] Filed: May 12, 1993

[51] Int. Cl.[5] ..... B05B 1/04; B05B 3/06

[52] U.S. Cl. ..... 239/246; 239/251; 239/600

[58] Field of Search ..... 239/246, 249, 251, 598; 134/167 R, 168 R

[56] References Cited

U.S. PATENT DOCUMENTS

| | | | |
|---|---|---|---|
| Re. 9,397 | 10/1880 | Sparrow | 239/251 |
| Re. 10,310 | 4/1883 | Pennington et al. | 239/251 X |
| 885,869 | 4/1908 | Schmidt | 239/251 X |
| 1,151,334 | 8/1915 | Bell | 239/251 |
| 2,573,786 | 11/1951 | Brodbeck et al. | 239/251 |
| 2,933,093 | 4/1960 | Handyside | 134/168 R |
| 4,030,513 | 6/1977 | McKenzie | 239/251 X |
| 5,096,122 | 3/1992 | Abramoska | 239/251 X |

FOREIGN PATENT DOCUMENTS

| | | | |
|---|---|---|---|
| 35156 | 3/1966 | Finland | 239/251 |
| 328018 | 4/1930 | United Kingdom | 239/246 |

OTHER PUBLICATIONS

"Automatic Tank Cleaning Equipment for the Industry" catalogue from TOFTEJORG A.S.

"Sellersclean" catalogue from MEA GMBH (German Language).

"Tank Washing Nozzles" catalogue from Spraying Systems Co.

"Tank Cleaning Nozzles" catalogue from Lechler.

"Turbodisc" catalogue from Breconcherry Steel Limited.

"Rotary Tank Rinsing Nozzle" catalogue from Spraying Systems Co.

"Type LT Low Flow Tank Cleaning Machine" from Butterworth Tank Cleaning Machines, Inc.

"Sugino Jet Cleaner, 3-Dimensional Jet Cleaning For Tanks" catalogue from Sugino Mahcine Ltd.

"Gamajet II, Automated Tank Cleaning" catalogue from Gamlen Chemical Sybron Corporation.

"Hydraulic Jet Cleaning Systems For All Industries" catalogue from Prosser Industries, Inc.

"Sellers Jumbo 6" catalogue from Prosser Industries Inc.

"Five ways to get better sanitation, Oakite Mechanized." Food Engineering (Sep., 1962), pp. 8-9.

*Primary Examiner*—David M. Mitchell
*Assistant Examiner*—William Grant
*Attorney, Agent, or Firm*—Bereskin & Parr

[57] ABSTRACT

A rotating spray nozzle has a nozzle mounting member, for attachment to a supply pipe. A nozzle body is rotatably mounted on the nozzle mounting member, and includes at least one, but preferably two, slot-shaped nozzles. Each slot-shaped nozzle generates a fan-shaped spray in a plane. Each nozzle is inclined to intersect the axis of the nozzle axis, to ensure thorough distribution of spray, on either side of the nozzle body, across the nozzle axis. The slot-shaped nozzles can be formed as slots in a unitary nozzle body.

14 Claims, 3 Drawing Sheets

ROTATING NOZZLE

FIELD OF THE INVENTION

This invention relates to spray nozzles and more particularly, to a self-driven, rotating spray nozzle assembly, for distributing the spray around the nozzle.

BACKGROUND OF THE INVENTION

Spray nozzles are utilized in many areas where a spray of fluid is required, for example: tank and drum washing; metal washing; foam control; asphalt spraying; vehicle washing; and dish washing. For tank and drum washing, one of the more popular forms of spray nozzles is the self-excited or self-driven rotating spray nozzle assembly. Such a nozzle assembly is secured to an end of a supply pipe and the device is inserted into the vessel to be cleaned either by means of entryways specifically designed for the purpose of cleaning the vessel, or by utilizing existing vessel entryways. The nozzle assembly comprises a fixed or stationary mounting element for mounting to the supply pipe, and a rotating nozzle body. A bore extends through the stationary mounting element to outlets which feed the rotating nozzle body rotatably mounted on an outlet end of the mounting element. Rotating spray nozzle assemblies generally have spray outlets which are provided in pairs opposite one another and at an angle to the axis of rotation. This provides driving forces to rotate the nozzle. The rotation is intended to distribute the spray over a specific area within the vessel to be cleaned. This area may include a portion of, or the complete interior of the vessel to be cleaned.

Inherent in the design of most nozzle units of this sort is the inability to achieve direct spray impact on either, or both, of the areas within the vessel directly in line with the axis of rotation of the rotating nozzle unit.

For many uses, the areas on the axis of the rotation of the nozzle are often the most critical areas needing spraying. Thus, spray nozzles are often used to clean a variety of containers, both for industrial uses and in the food and beverage industry. In all cases, it is exceedingly important that a vessel be fully and completely cleaned. In the case of food or beverage containers, often a residual part of the original contents will be left at the bottom, which will dry, and present problems in washing or cleaning. The base of the container is usually on the axis of a rotating spray nozzle. At the other end of the container, due to exposure to the atmosphere, portions of the contents can become encrusted around the neck or opening of the container, which is also on the axis of the spray nozzle.

To ensure proper cleaning of these areas, it is necessary that they be subjected to a vigorous spraying action.

SUMMARY OF THE INVENTION

In accordance with the present invention there is provided a rotating spray nozzle comprising a nozzle mounting member adapted for fitting to a supply pipe;

a nozzle body rotatably mounted on the nozzle mounting member, for rotation about a nozzle axis, and having an internal cavity in communication with the nozzle mounting member, for supply of fluid;

and at least one slot-shaped nozzle in the nozzle body, extending from the internal cavity, and defining a nozzle plane that intersects the nozzle axis, the nozzle being offset from the nozzle axis to cause the nozzle body to rotate.

Preferably, the nozzle body includes a pair of slot-shaped nozzles, in generally opposite sides of nozzle body. Each nozzle is offset from the nozzle axis, to impart a driving couple to the nozzle body, to cause it to rotate. In this case, one nozzle should be inclined to intersect the nozzle axis adjacent one end of the nozzle body and remote from the nozzle mounting member, while the other nozzle is inclined to intersect the nozzle axis proximate the nozzle mounting member, adjacent the other end of the nozzle body.

Preferably, each of the slot-shaped nozzles are defined by generally parallel side faces and a straight rear end face. The end faces are preferably inclined at an angle of approximately 30° relative to the nozzle axis, as viewed from the side. This enables one nozzle to be inclined to intersect the axis at one end of the nozzle body, while the other nozzle is inclined in the other direction to intersect the axis at the other end of the nozzle body.

Conveniently, the nozzle body, including the nozzle slots, is integrally formed as a one-piece element, either by moulding from plastic material, or machining from metal. This provides a simple, robust construction, capable of providing the necessary spray action.

To ensure that the spray is directed generally parallel to an input supply pipe, the external radius of the nozzle body and more preferably its internal radius should be greater than the radius of the nozzle mounting member, which usually will correspond to the radius of any supply pipe.

This arrangement provides a spray pattern, including one spray that will intersect the axis at one end of the nozzle body, remote from the nozzle mounting member, to ensure vigorous and uniform spraying action on, for example, the base of a container. Similarly, at the other end of the nozzle body, i.e. close to the nozzle mounting member, a spray pattern is provided that would normally intersect the nozzle axis; usually, the presence of the supply pipe will prevent this intersection. Nonetheless, the portion includes a spray that is directed parallel to the nozzle mounting member of the inlet pipe, to ensure thorough washing of, for example, an inlet of a container.

BRIEF DESCRIPTION OF THE DRAWINGS

For a better understanding of the present invention and to show more clearly how it may be carried into effect, reference will now be made, by way of example, to the accompanying drawings, which show preferred embodiments of the present invention and in which.

DESCRIPTION OF PREFERRED EMBODIMENTS

Figure 1:
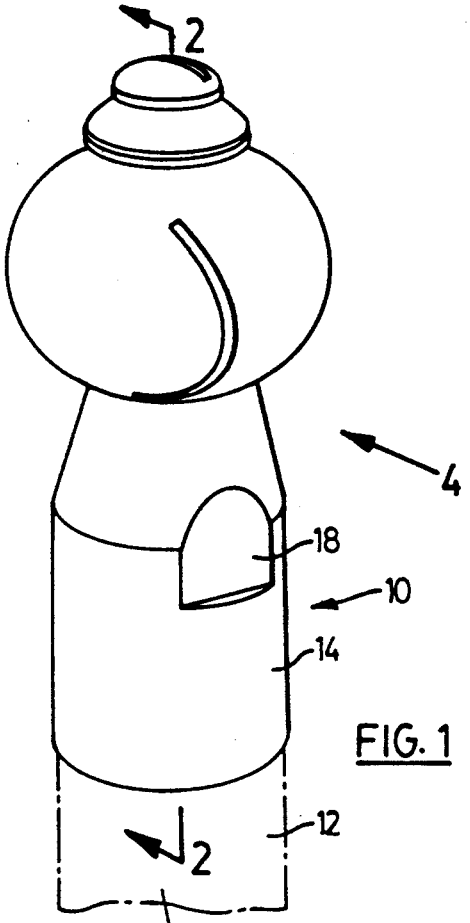
FIG. 1 is a perspective view of a first embodiment of a rotating nozzle assembly according to the present invention, mounted on a pipe.

A rotating spray nozzle according to the present invention is generally indicated by the reference 10. It is shown attached to a supply pipe, indicated by the reference 12.

The spray nozzle has a mounting member 14, which has a base portion 16 provided with an internal screw thread for attachment to corresponding external thread of the supply pipe 12. In known manner, it is provided with opposing flat surfaces 18, for engagement of a wrench for secure engagement with the supply pipe 12.

The base portion 16 extends through a frusto-conical portion 20, to a top portion 22. The top portion 22 is generally cylindrical and includes an annular bearing part 24 adjacent the frusto-conical portion 20. The interior of the top portion 22 is a cylindrical bore, continuing from the base portion 16. Openings 26 are provided for fluid flow.

Figure 2:
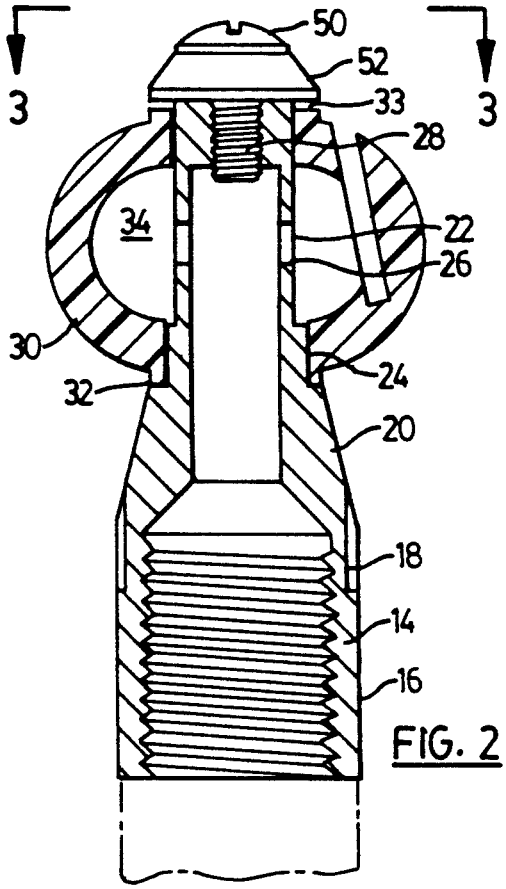
FIG. 2 is a sectional view along line 2—2 of FIG. 1.

Mounted on the top portion 22 is a nozzle body 30. The nozzle body 30 has a shape of a generally flattened spheroid. As shown in the section of FIG. 2, each side of the nozzle body 30 is generally semicircular, with a central portion being straight and horizontal at the top and the bottom. The body 30 has a generally uniform wall thickness. The body 30 has bottom and top bores 32, 33, which provide bearing surfaces. As shown, the body 30 is extended axially around the bores 32, 33. The diameters of the bores 32, 33 correspond, respectively, to the diameter of the annular bearing 24 and the diameter of the cylindrical top portion 22. This ensures that the nozzle body 30 can only be oriented in one way.

The body 30 defines an internal cavity 34 having a similar shape to the exterior of the nozzle body 30.

To secure the nozzle body 30 in position, a screw 50 is provided, engaging a threaded bore 28 of the top portion 22. Either integral with the screw 50, or as a separate element, is a conical washer 52. The screw 50 is tightly engaged in the bore 28, with the nozzle body being dimensioned for free rotation about the mounting element 14.

Figure 4:
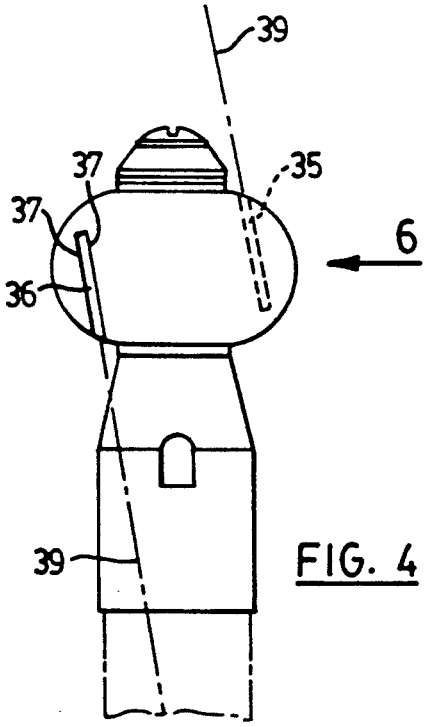
FIG. 4 is a side view in the direction of arrow 4 of FIG. 1, of the first embodiment of the nozzle assembly showing nozzle angles.

Spray nozzles are formed in the nozzle body 30, by two slots 35 and 36. Each slot is generally planar and of uniform width. The slot nozzles are defined by parallel side faces 37 and straight end faces 38. As is clearly shown in FIG. 2, the slots are positioned so as to be generally tangential to the interior cavity 34. As FIG. 4 shows, there is a plane 39 associated with each slot 35, 36, and each of the slot-shaped nozzles 35, 36 will generate a fan-shaped spray extending in its respective plane. As FIG. 4 also shows, each plane is inclined at an angle relative to the axis of the spray nozzle 10. For the top slot-shaped nozzle 35, the plane intersects the axis above the spray nozzle 10, as viewed in FIG. 4; correspondingly, for the bottom nozzle 36, the plane intersects the axis below the nozzle body 30. The planes of the two nozzles, 35, 36 are generally parallel to one another, as are all the side faces 37. The straight end faces 38 are also parallel to one another.

Figure 3:
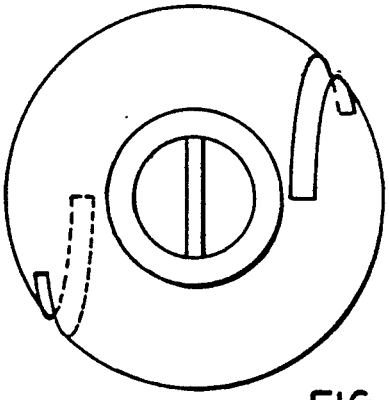
FIG. 3 is a top view of the nozzle assembly along line 3—3 of FIG. 2.

In known manner, as shown in FIG. 3, the slots 35, 36 are also angled so as to provide reactionary force on the body 30 that is offset from its axis, the two forces being on the opposite sides of the axis, to develop a couple or moment causing the body 30 to rotate.

FIGS. 2 and 4 show another important characteristic of the configuration of a nozzle 10; the internal diameter of the cavity 34 is greater than the diameter of the mounting member 14. The bottom nozzle 36 is substantially outside the diameter of the base portion 16. This enables it to deliver spray, at least parallel to the outside surface of the base portion 16 and a supply pipe 12 of similar diameter.

Figure 5:
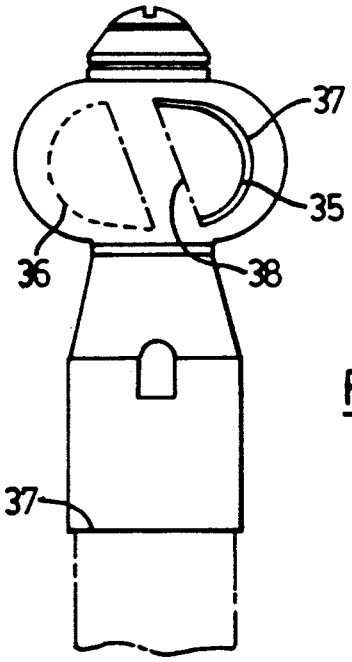
FIG. 5 shows a side view, similar to FIG. 4, showing details of the nozzle angles.

FIG. 5 shows a further important characteristic of the two nozzles, 35, 36. The straight end faces 38 of each nozzle is inclined, as viewed from the side in FIG. 6, relative to the axis of the nozzle, by approximately 30°. This causes the nozzle 35 to be directed upwardly, to ensure that its spray pattern intersects the nozzle axis; similarly, the bottom nozzle 36 is directed downwards, to ensure intersection with the nozzle axis, absent any obstructions. The depth of the slot nozzles 35, 36 will determine the angular coverage of the fan spray produced. This can be adjusted as desired.

With regard to materials for the rotating spray nozzle 10, these can comprise suitable plastic such as nylon or a glass filled polypropylene, or a metal such as stainless steel. In general, the materials should not be corroded or attacked by materials to which they will be subjected in use.

In the embodiment of FIGS. 1–5, the mounting member 14 is formed from stainless steel, while the nozzle body 30 is formed from a suitable plastic material. These two materials form a natural bearing surface between them, and no separate bearing element is required.

Figure 7:
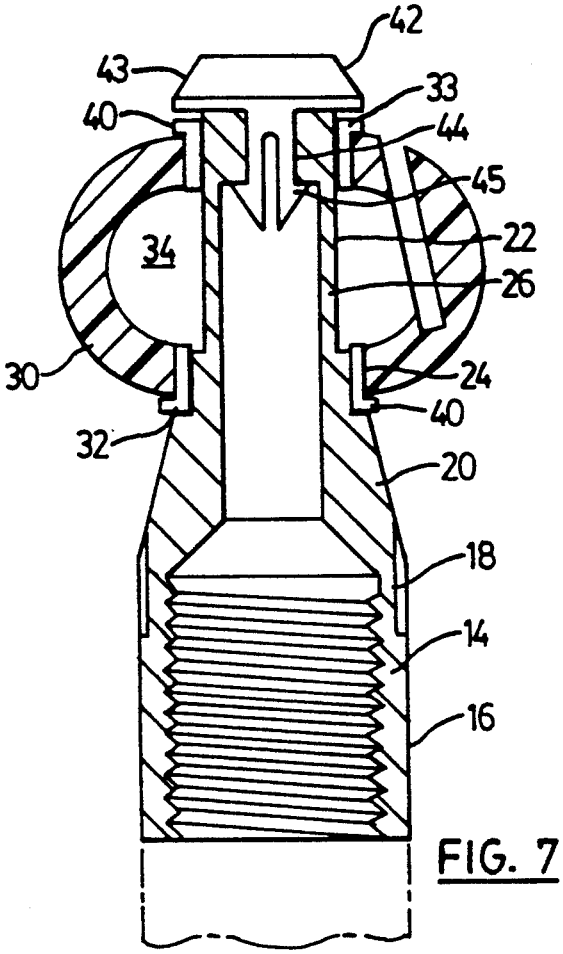
FIG. 7 shows a view corresponding to the view of FIG. 2 of a second embodiment of a rotating spray nozzle according to the present invention.

FIG. 7 shows a second embodiment, with like parts being of the same reference numeral as in the first embodiment, for simplicity and brevity.

Here, the mounting member 14 and the nozzle body 30 are both formed from metal, for example, stainless steel. To provide a bearing surface, two bearing bushings 40 are provided, which are pressed fit in the nozzle body 30, and in known manner, have suitable clearance around the top portion 22 and annular bearing part 24.

FIG. 7 also shows a different securing arrangement. Here, a retaining clip 42 is provided. The clip 42 has a head 43, shaft 44 and engagement surfaces 45 in known manner. The shaft 44 is bifurcated, and the engagement surfaces 45 resiliently pressed inwards during insertion of retaining clip 42. When fully inserted, they would spring outwards, to engage shoulders inside the mounting member 14, as shown. In this version, the clip 42 effectively has an integral washer, so no separate washer is required.

The use of a screw 50 has advantages in that it enables the spray nozzle 10 to be readily dismantled for servicing, e.g. for cleaning or to replace the nozzle body 30 if it is worn or damaged. Where a screw is provided, it should be ensured that the direction of rotation of the nozzle body 30 is the same as the direction in which the screw is rotated during insertion. Then, any material that becomes trapped or caught between the nozzle 30 and the screw 50 will tend to apply a torque to it tightening the screw, rather than loosening it.

Thus, where the nozzle body 30 is configured for counter clockwise rotation, as viewed in the plan of FIG. 3, then the screw 50 should be provided with a left hand thread.

Figure 6:
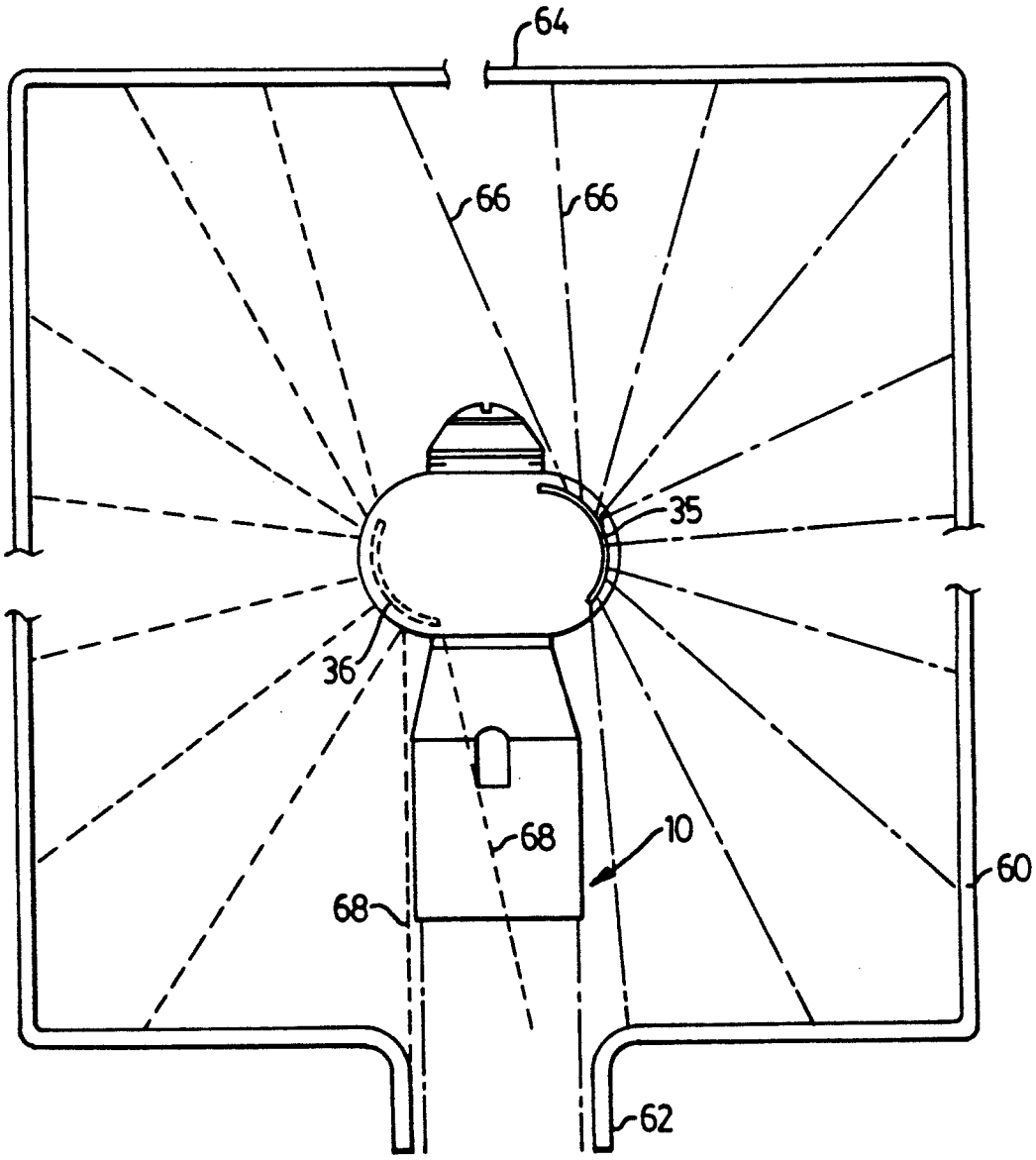
FIG. 6 shows the spray pattern produced by the nozzle assembly of the present invention, with the nozzle assembly viewed in the direction of arrow 6 of FIG. 4.

FIG. 6 shows a spray nozzle in use, in a vessel indicated at 60; the exact configuration of the vessel 60 can vary widely. Here, the vessel is indicated schematically, and includes a neck or opening 62, and a base 64. In FIG. 6, the vessel 60 is shown inverted for washing purposes.

In use, fluid flows through the mounting member, its openings 26 and the internal cavity 34. The shape of the cavity 34 along with the tangential arrangement of the nozzles 35, 36 defines the shape and rate of fluid flow through the nozzles 35, 36.

Now, for many uses, it is common for material to accumulate and become encrusted around the neck 62 and base 64. In particular, in the food and beverage industries, it is common for part of the contents to dry out and become encrusted around the neck 62. Similarly, it is common for a small residue of the original contents to be left in the vessel, which can dry out, to leave an encrusted residue on the base 64. Other parts of the vessel may often show little residue from the original contents, so as to present little difficulties in washing or cleaning. It can also be noted that two areas, the neck 62 and base 64, are on the axis of the spray nozzle 10 and hence present the greatest difficulty in terms of washing and cleaning.

However, as shown in FIG. 6, with the spray nozzle 10 of the present invention, both the neck 62 and base 64 are subject to thorough cleaning and spraying from the nozzles or slots 35, 36. Thus, as shown at 66, the top slot or nozzle 35 produces a spray pattern that crosses the axis of the nozzle 10, thereby ensuring complete coverage of the base 64 with spray.

Similarly, the slot or nozzle 36 produces a spray pattern capable of intersecting the axis of the nozzle 10, as indicated at 68. As shown by the dotted line 69, the greater radius of the nozzle body 30, relative to the mounting element 14, ensures that spray can be directed parallel to the axis, at the neck 62. This should ensure thorough cleaning of the interior of the neck or inlet 62.

It will be appreciated that while preferred embodiments have been described, various modifications and variations are encompassed by the present invention. In particular, individual elements of the two embodiments of FIGS. 1-5 and FIG. 7 can be interchanged where possible. Thus, the first embodiment could alternatively be provided with a retaining clip instead of a screw. Similarly, in the second embodiment, with bearing bushings, a screw could be used to retain the nozzle body in place. The nozzle body or ball 30 could be formed from two or more separate elements, e.g. two halves screwed together, to permit formation of more complex internal profiles. The nozzle mounting member as well as the nozzle body could be moulded from a plastic material, for simple and economic manufacture.

I claim:

1. A rotating spray nozzle comprising:

a nozzle mounting member adapted for fitting to a supply pipe;

a nozzle body rotatably mounted on the nozzle mounting member, for rotation about a nozzle axis, and having an internal cavity in communication with the nozzle mounting member, for supply of fluid;

and a pair of slot-shaped nozzles in the nozzle body, extending from the internal cavity and each defining a nozzle plane that inersects the nozzle axis, wherein the slot-shaped nozzles intersect the nozzle body on generally opposite sides of the nozzle body and each nozzle is offset from the nozzle axis, to impart a driving couple to the nozzle body, to cause rotation thereof, and wherein one nozzle is inclined to produce a spray pattern intersecting the nozzle axis, adjacent one end of the nozzle body, remote from the nozzle mounting member, and the other nozzle is inclined to produce a spray pattern intersecting the nozzle axis proximate the nozzle mounting member, adjacent the other end of the nozzle body.

2. A rotating spray nozzle as claimed in claim 1, wherein both the nozzle mounting member and the nozzle body are generally circular, and the nozzle body has a radius greater than the radius of the nozzle mounting member, and wherein at least the other nozzle has a portion located at a greater radial extent than the radius of the nozzle mounting member.

3. A rotating spray nozzle as claimed in claim 2, wherein each of the slot-shaped nozzles is defined in the nozzle body by generally parallel side faces, and a straight rear end face.

4. A rotating spray nozzle as claimed in claim 3, wherein the straight rear end faces of the slot-shaped nozzles are inclined at an angle of approximately 30° relative to the nozzle axis, with the one nozzle being inclined towards the nozzle axis remote from the nozzle mounting member, and the other nozzle being inclined towards the nozzle axis proximate the nozzle mounting member.

5. A rotating spray nozzle as claimed in claim 4, wherein the slot-shaped nozzles are generally parallel with one another, and generally tangential with the internal cavity of the nozzle body.

6. A rotating spray nozzle as claimed in claim 2, 3, 4, 5, wherein the nozzle body, including the slot-shaped nozzles, comprises a unitary part.

7. A rotating spray nozzle as claimed in claim 2, 3, 4, 5, wherein the rotating spray nozzle has a generally spheroidal shape, with generally flat end surfaces, perpendicular to the nozzle axis, with the internal cavity having a corresponding shape.

8. A rotating spray nozzle as claimed in claim 2, 3, 4, 5, wherein the nozzle mounting member includes a base portion for attachment to a supply pipe, and a top portion which is generally cylindrical and includes an annular bearing part adjacent to the base portion of larger diameter, and wherein the nozzle body includes first and second bores having diameters corresponding to the diameters of the top portion and the annular bearing part respectively, whereby the nozzle body can only be mounted in one orientation on the nozzle mounting member.

9. A rotating spray nozzle as claimed in claim 1, 2 or 3, wherein each spray nozzle is tangential with the internal cavity.

10. A rotating spray nozzle as claimed in claim 5, wherein the nozzle body has a generally spheroidal shape with substantially planar end surfaces perpendicular to the nozzle axis, and the nozzle body, including the slot-shaped nozzles, is formed as a unitary component.

11. A rotating spray nozzle as claimed in claim 10, wherein the nozzle mounting member includes a base portion for attachment to a supply pipe, and a top portion which is generally cylindrical and includes an annular bearing part adjacent to the base portion of larger diameter, and wherein the nozzle body includes first and second bores having diameters corresponding to the diameters of the top portion and the annular bearing part respectively, whereby the nozzle body can only be mounted in one orientation on the nozzle mounting member.

12. A rotating spray nozzle as claimed in claim 10 or 11, wherein the nozzle body is moulded from a plastic material.

13. A rotating spray nozzle as claimed in claim 10 or 11, wherein the nozzle body is formed from metal, and includes bearing bushings, for forming bearings with the nozzle mounting member.

14. A rotating spray nozzle as claimed in claim 10 or 11, wherein the nozzle body is retained on the nozzle mounting member by one of a screw and washer combination, and a retaining clip having engagement projections engaging internal shoulders of the mounting member.

* * * * *